US006431161B1

(12) United States Patent
Gustafsson

(10) Patent No.: US 6,431,161 B1
(45) Date of Patent: Aug. 13, 2002

(54) DEVICE FOR THROWING TARGETS

(75) Inventor: Gösta Gustafsson, Arboga (SE)

(73) Assignee: Gosta Gustafssons Mekaniska Verstad AB, Arboga (SE)

( * ) Notice: Subject to any disclaimer, the term of this patent is extended or adjusted under 35 U.S.C. 154(b) by 0 days.

(21) Appl. No.: 09/785,167

(22) Filed: Feb. 20, 2001

(51) Int. Cl.[7] ..... F41J 9/18
(52) U.S. Cl. ..... 124/8
(58) Field of Search ..... 124/6, 7, 8, 9, 124/46, 47

(56) References Cited

U.S. PATENT DOCUMENTS 5,249,563 A * 10/1993 Patenaude ..... 124/8
5,406,928 A * 4/1995 Panara et al. ..... 124/8
6,176,229 B1 * 1/2001 Patenaude ..... 124/8

* cited by examiner

*Primary Examiner*—John A. Ricci
(74) *Attorney, Agent, or Firm*—Sughrue Mion, PLLC

(57) ABSTRACT

A target throwing device, particularly for throwing two frangible targets, such as "clay targets", comprises a magazine for holding targets having a circular top portion and a depending wall portion, an essentially planar throwing plate, and an elevator for moving targets from the magazine onto the throwing plate. A throwing arm is mounted above the throwing plate for moving the targets from first positions to second positions and for subsequently throwing the targets when in the second positions. A positioning element is protruding upwardly from the throwing plate within the wall portion of an inner target when it is lowered onto the throwing plate so as to impart to the target a movement in a direction from an outer target during movement of the targets from the first to the second positions. The targets are thereby less prone to breaking and more accurate target trajectories are achieved.

6 Claims, 4 Drawing Sheets

DEVICE FOR THROWING TARGETS

FIELD OF INVENTION

The present invention relates generally to the dispensing of objects and particularly to a device for automatically throwing, simultaneously, two frangible targets, such as "clay targets" or "clay pigeons".

BACKGROUND OF THE INVENTION

Devices for throwing plate type targets wherein the throwing or catapult arm is mechanically driven are well known in the art. The prior art devices generally comprise a throwing arm designed to accommodate a frangible target plate and mounted on one end of a rotatable shaft. The targets are lowered onto a plate for the subsequent throwing thereof by means of the throwing arm.

A problem in the prior art devices is that when two targets are moved simultaneously by means of the throwing arm to their respective throwing position, the targets tend to move into contact with each other, i.e., adjacent to each other, resulting in the possible breakage of the targets before or during the throwing thereof. Also the accuracy of the throwing trajectories are impaired when the two targets are contacting each other.

SUMMARY OF THE INVENTION

An object of the present invention is to provide a device for throwing targets wherein the above mentioned problem is avoided or at least mitigated and wherein the targets, in throwing positions, are separated by a mutual distance.

The invention is based on the insight that a pin or the similar protruding from the throwing plate can be used to position one of the targets so as to achieve a desired mutual distance between two targets to be thrown.

According to the invention there is provided a target throwing device comprising a magazine for holding targets having a circular top portion and a depending wall portion, an essentially planar throwing plane, an elevator for moving a first and a second target from said magazine to a respective first position on said throwing plane, an arm mounted above said throwing plane for moving said first and second targets from said first positions to second positions and for subsequently throwing said first and second targets when in said second positions, and a positioning element protruding upwardly from said throwing plane within said wall portion of said first target when said target is in said first position so at to impart to said first target a movement in a direction from said second target during movement of said first target from said first to said second position.

With the inventive device, a mutual distance between two targets to be thrown is achieved, thereby lessening the possible risk of breakage of the targets when positioned on the throwing plate. Also the throwing trajectories will become more accurate and single target throwing with either the left or right target is improved.

BRIEF DESCRIPTION OF THE DRAWINGS

The present invention may be better understood and its objects and advantages will become apparent to those skilled in the art by reference to the accompanying drawings wherein like reference numerals refer to like elements in the several figures and in which.

DETAILED DESCRIPTION OF THE INVENTION

Figure 1:
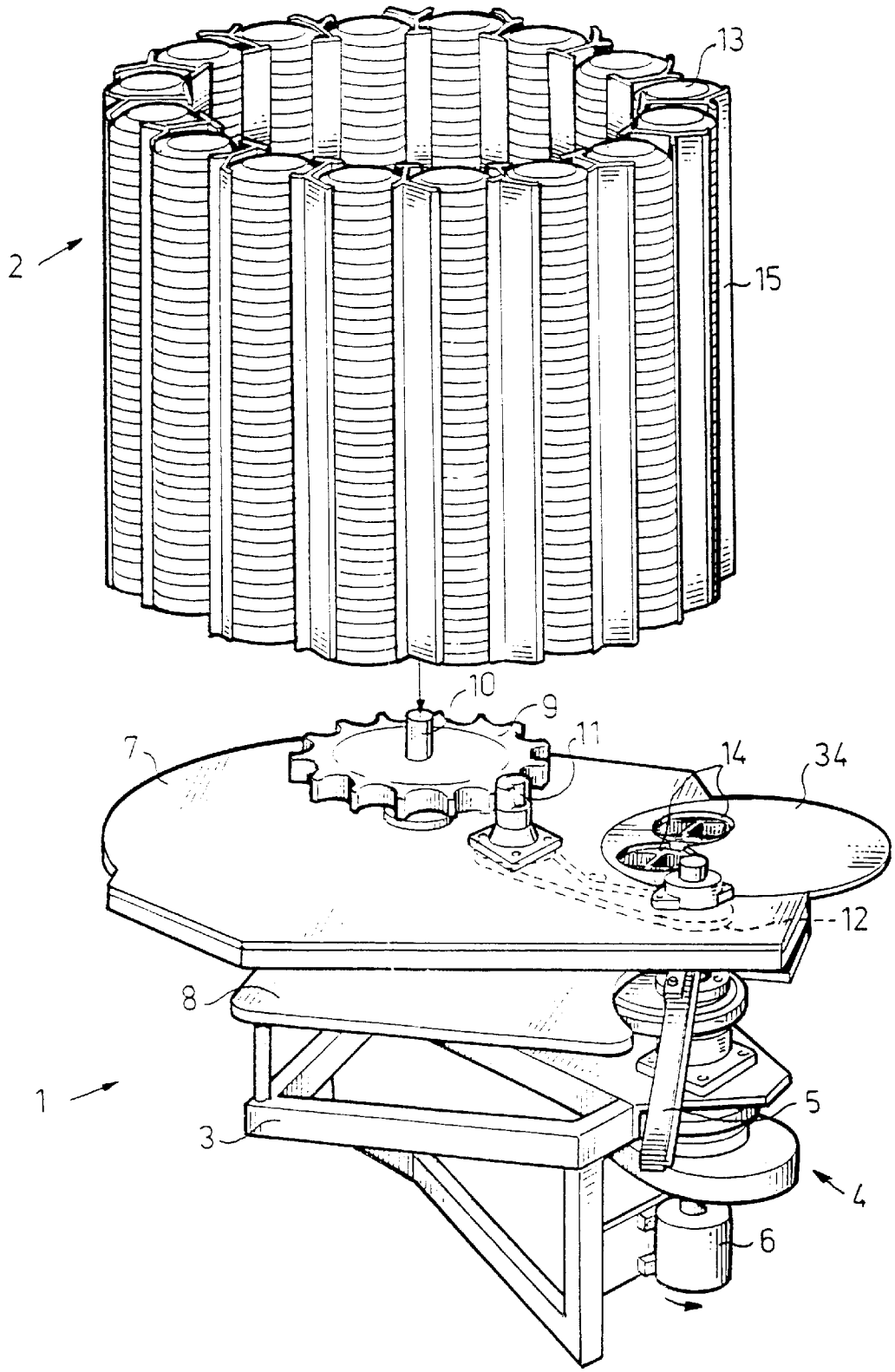
FIG. 1 is a perspective view of a target-throwing device in accordance with the present invention.

Referring now to FIG. 1, a target-throwing device is depicted, which consists of two main parts, namely, a lower part 1, which represents the actual trap for clay targets with a cocking and hurling arrangement, and a rotatable, round magazine 2 arranged above this lower part 1 of the machine, with arrangements for the reception of a fairly large number of clay targets and for the automatic placement each time of one or two of these targets on the lower part 1.

The lower part 1 has a frame 3 which is mounted in the customary manner on a support, not shown, which may be adjustable for vertical as well as lateral movement, so that the direction of the throw can be adjusted. The frame 3 mounts a shaft assembly, generally designated 4, for a throwing arm 5 pivoting about the shaft assembly as well as for the magazine 2. The shaft assembly 4 is driven by a drive motor 6 connected to one end of the shaft assembly, preferably by means of a gear so as to give the shaft assembly a suitable rotational speed.

The lower part 1 further comprises a top plate 7 supporting the magazine and a lower plate 8, intended for support of targets ready to be thrown. The magazine 2 is supported by means of a toothed wheel 9 having an upwardly directed tap 10, onto which the magazine is placed. The toothed wheel 9 is rotated by means of a driving tap 11, which in turn is driven by the shaft assembly 4 by means of a driving chain 12.

A turnable disc 34 is mounted in the top plate 7 and on level therewith. Thereby the top plate 7 and the disc form one plane on which the stacks of targets 13 in the magazine can slide. The disc 34 is provided with two circular holes or apertures 14*a*, 14*b*, each having a diameter adapted to receive a target 13 from the magazine 2. Stacks of targets 13 are held in place in the magazine by means of profile elements 15 placed in a circle, see FIG. 1.

Figure 2:
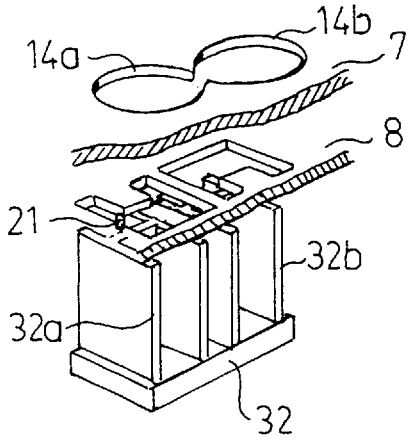
FIG. 2 is a perspective view of a positioning arrangement of the device shown in FIG. 1.
Figure 7A:
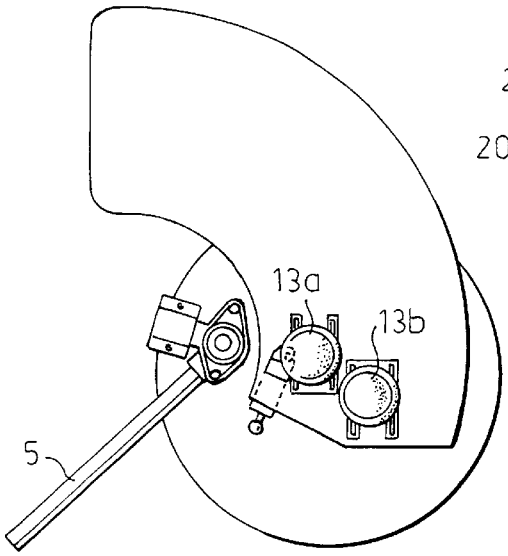
FIGS. 7*a* and 7*b* are overall top views of two targets on the throwing plate before and after they have been moved to their throwing positions, respectively.

The positioning arrangement of the inventive throwing device will now be described in detail, first with reference to FIG. 2. In FIG. 2 there is shown how the two apertures 14*a*, 14*b* lie directly above an elevator arrangement 32 comprising two H-shaped profiles 32*a*, 32*b*, one below a respective aperture. There are provided slits in the lower plate or throwing plate 8 for receiving the profiles so that the elevator arrangement can be moved from an upper position in which targets can be collected from the magazine 2 (not shown in FIG. 2) to a lower position below the throwing plate, thereby leaving the targets collected from the magazine on the throwing plane.

Figure 3:
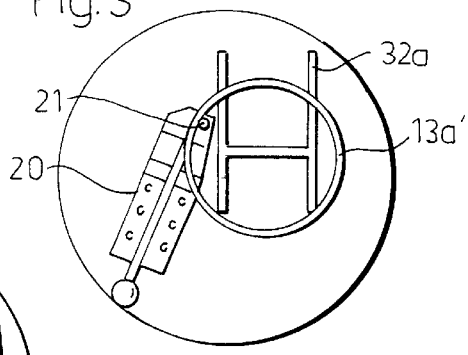
FIG. 3 is a plan view of the positioning arrangement shown in FIG. 2.

In FIG. 2 there is also shown a steering pin element 21 protruding upwardly from the throwing plate 8. The pin is positioned below the radially inner aperture 14*a* so as to be below the target lowered through that inner aperture and onto the throwing plate 8, i.e., to be within the periphery of that target. This is more clearly visible in FIG. 3, wherein the periphery of the first target in its first position is designated 13*a*'. It is also seen that the pin 21 is positioned within that periphery.

Figure 4:
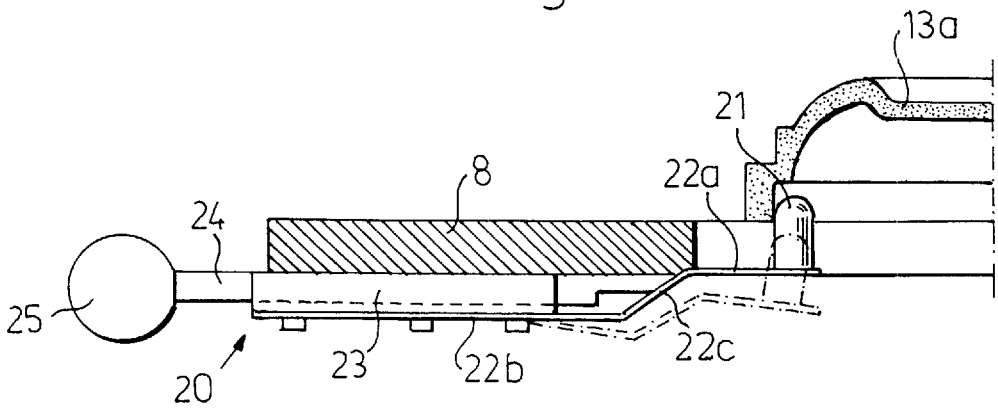
FIG. 4 is a side view of the arrangement shown in FIG. 3.

In FIG. 4 there is shown a detailed side view of the positioning arrangement 20 comprising the pin 21. The pin is protruding upwardly from a first upper portion 22*a* of a leaf spring attached at a second lower portion 22*b* to an attachment body 23. The first and second portions of the leaf spring are interconnected by a straight interconnection portion 22*c*. The attachment body is fixedly attached to the underside of the throwing plate 8. As can be seen in FIG. 4, the pin protrudes slightly above the plane of the throwing plate 8 in an opening therein.

There is also provided a tap 24 slidingly movable in the attachment body by means of a handle knob 25. When the tap is moved inwardly by means of the knob, i.e., to the right of the figure, the tap contacts the interconnection portion 22*c* of the leaf spring, thereby pushing it downward to the lower position indicated by dashed lines in the figure. In that lower position of the leaf spring, the pin 21 is in a position wherein it does not protrude above the plane of the throwing plate 8, thereby disabling its function. This deactivation of the positioning arrangement can be used when throwing just one target at a time, for example.

Figure 5A:
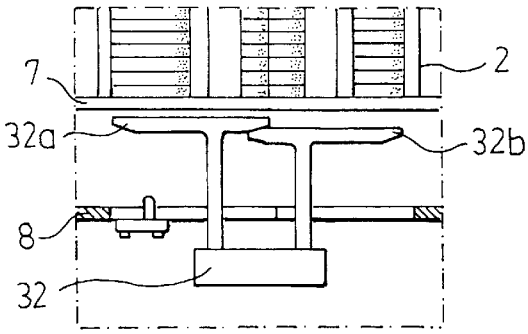
FIGS. 5*a–d* are side views showing different positions of an elevator arrangement used for lowering targets from a magazine onto a throwing plate.

The procedure of lowering two targets from a position in the magazine 2 to a position on the throwing plate 8 will now be described in detail with reference to FIGS. 5*a–d*. In FIG. 5*a*, the elevator 32 is shown in its upper position, in which the two targets are collected from the magazine 2. The H-profile 32*b* of the elevator for the second outer target is positioned slightly lower than the H-profile 32*a* for the first inner target, the meaning of which will be explained below.

Figure 5B:
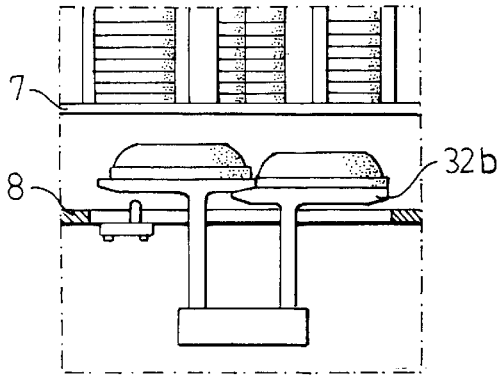
Figure 5C:
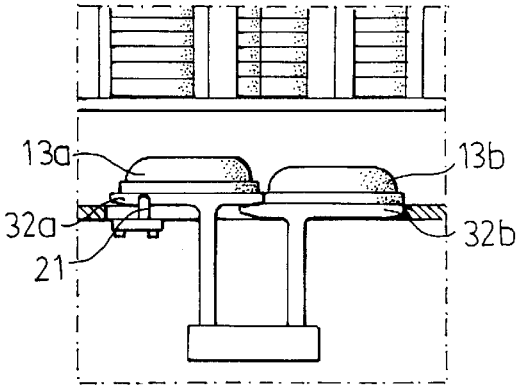

In FIG. 5*b* there is shown a position for the targets between the upper plate 7 and the lower throwing plate 8. In FIG. 5*c* the second target 13*b* has been placed on the throwing plate 8 by the elevator profile 32*b* while the first target is still slightly above the throwing plate. In that way, due to the difference in level between the two H-profiles 32*a*, 32*b*, simultaneous placement of the two targets on the throwing plate is avoided, thereby lessening the risk of breaking the targets.

Figure 5D:
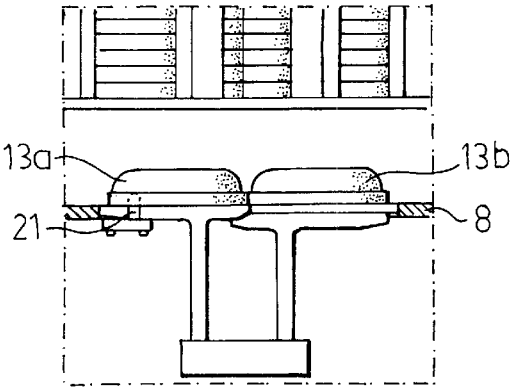

Finally, in FIG. 5*d* there is shown how the first target 13*a* has been lowered onto the throwing plate 8. It is also seen how the pin 21 is protruding from the throwing plate within the periphery of the first target, i.e., the pin is in space defined by the sidewall of the first target. Due to this positioning, the pin functions as a positioning or guiding arrangement, as will be described in following with reference to FIG. 6.

Figure 6:
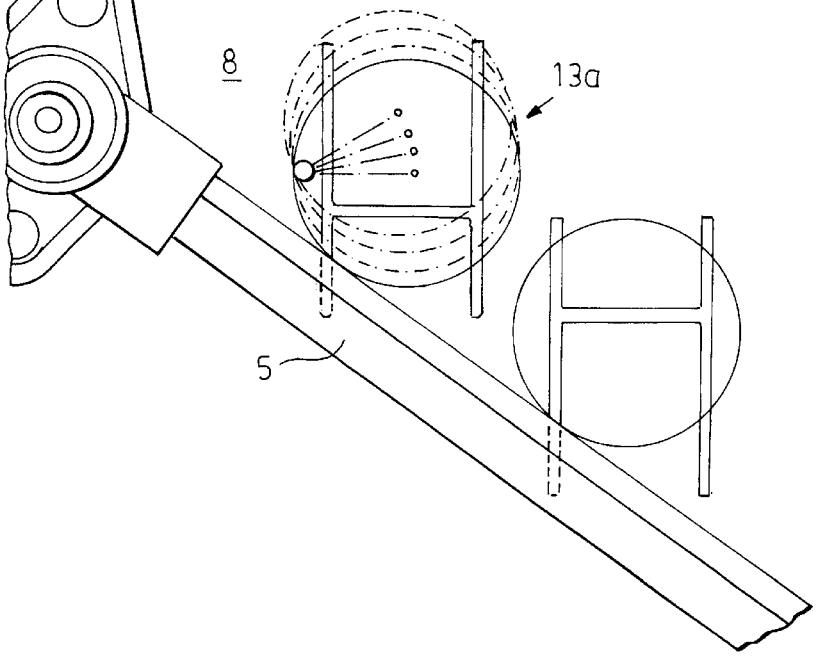
FIG. 6 is a top view of a target being moved to a throwing position.

In FIG. 6, being a plan view of the throwing plate 8, the position of the throwing arm 5 is shown just before contacting the first target 13*a* in its first position, i.e., the position shown in FIG. 5*d*, wherein the target has been lowered onto the throwing plate by means of the elevator 32. The position of the pin within the periphery of the first target is also shown. The first target is shown in several positions as it is being moved by the throwing arm 5 during its movement from the position shown in FIG. 6 and to its position just before the targets are thrown, see FIG. 7*b*. In FIG. 6 is it clear how the first target is guided by the pin and is moved in an arc by the throwing arm 5. Thus, instead of moving radially outward from the shaft 4 of the throwing arm by the centrifugal force, as would be the case should there be no steering pin, the first target is instead moving radially inward towards the rotational center of the throwing arm and away from the second outer target. During the final movement of the throwing arm 8 just before reaching the throwing position, the force acting on the first target by the throwing arm is larger than the retaining force acting on the first target by the steering pin. The pin is therefore forced down against the spring force of the leaf spring and the first target is allowed to pass above the pin. In that way, when the first and second targets have been moved to the second position or throwing position, shown in FIG. 7*b*, there is a small gap between the two targets.

Figure 7B:
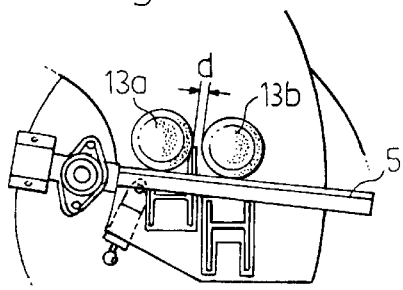

From the throwing position shown in FIG. 7*b*, the two targets are subsequently thrown by means of the arm 5 in two different directions. Thus, the first and second targets are separated by a distance d, see FIG. 7*b*, thereby avoiding friction therebetween during the throwing thereof. The targets are then less prone to breaking and the throwing trajectories become more accurate. Also, during single target throwing with the left target, its throwing direction can be accurately determined by means of the positioning arrangement.

When single-throw action is desired, only one target at a time is lowered by the elevator. This is accomplished by a retaining arrangement (not shown) preventing the lowering of either the first or the second target from the magazine 2. In that case, the steering pin can be lowered as was described with reference to FIG. 4, thereby deactivating its function.

While a preferred embodiment has been shown and described, various modifications may be made thereto without departing from the inventive idea of the present invention. Accordingly, it is to be understood that the present invention has been described by way of illustration and not limitation. Thus, a specific positioning arrangement has been described. It will be appreciated that this positioning arrangement can take any suitable shape. Thus, instead of having a leaf spring acting on the steering pin, another kind of spring could be provided. Alternatively, no spring function is needed if the target is allowed to pass above the steering pin in another way. If the steering pin is below the target in the throwing position, the target is prone to breaking.

Also, it is not necessary to have a deactivation function for the positioning arrangement, i.e., it could be in operation during single-throw action as well.

A pin acting on the first inner target has been described. However, a similar pin acting on the second outer target can also be provided replacing or supplementing the pin acting on the inner target.

The two apertures 14*a*, 14*b* in the upper plate 7 have been shown completely separated. In an alternative embodiment, these two apertures are joined so as to be one single aperture with the general shape of an "8".

What is claimed is:

1. A target throwing device having:

a magazine for holding targets having a circular top portion and a depending wall portion;

an essentially planar throwing plate;

an elevator for moving a first and a second target from said magazine to a respective first position on said throwing plate;

an arm pivotally mounted above said throwing plate for moving said first and second targets from said first positions to second positions and for subsequently throwing said first and second targets when in said second positions; and a positioning element protruding upwardly from said throwing plate within said wall portion of said first target when said first target is in said first position so as to impart to said first target a movement in a direction from said second target during movement of said first target from said first to said second position.

2. The target throwing device according to claim 1, wherein said elevator comprises a first portion for accommodating said first target and a second portion for accommodating said second target, and wherein said first and second portions of said elevator are positioned in different planes.

3. The target throwing device according to claim 2, wherein said positioning element comprises a pin protruding upwardly from said throwing plate.

4. The target throwing device according to claim 3, wherein said positioning element comprises a leaf spring and wherein said pin is attached to said leaf spring.

5. The target throwing device according to claim 4, comprising a deactivation element arranged to act on said leaf spring so as to move said pin from a position wherein it is protruding upwardly from said throwing plate to a position wherein it is positioned below said throwing plate.

6. The target throwing device according to claim 1, wherein the distance between said first target and a pivot axis for said arm is less than the distance between said second target and said pivot axis.

* * * * *